US005695087A

United States Patent [19]

Tutton et al.

[11] Patent Number: 5,695,087

[45] Date of Patent: Dec. 9, 1997

[54] CONTAINER WITH LATCHING LID

[75] Inventors: John Tutton, North Gower; Mike Sirois, Ottawa; Jerome Foy, Canton Orford; Mike Pears, Scarborough, all of Canada

[73] Assignee: Canada Post Corporation, Ottawa, Canada

[21] Appl. No.: 430,401

[22] Filed: Apr. 28, 1995

[51] Int. Cl.[6] ..... B65D 45/16

[52] U.S. Cl. ..... 220/324; 206/508; 220/796; 220/315

[58] Field of Search ..... 206/508, 503; 220/503, 324, 326, 306, 307, 355, 780, 781, 784, 789, 792, 799, 796, 800, 801, 802, 315

[56] References Cited

U.S. PATENT DOCUMENTS

| | | | |
|---|---|---|---|
| 1,062,635 | 5/1913 | Clements . | |
| 1,232,216 | 7/1917 | Caron . | |
| 3,419,184 | 12/1968 | Asenbauer | 220/355 X |
| 3,546,752 | 12/1970 | Sargent | 220/324 |
| 4,071,064 | 1/1978 | Saul | 220/324 |
| 4,270,668 | 6/1981 | Berfield | 220/324 |
| 4,548,320 | 10/1985 | Box . | |
| 4,832,200 | 5/1989 | Deaton et al. . | |
| 4,874,103 | 10/1989 | Quisenberry et al. | 220/306 X |
| 4,976,370 | 12/1990 | Cassel | 220/355 |
| 4,986,438 | 1/1991 | Borst | 220/324 X |
| 5,143,219 | 9/1992 | Yates, Jr. . | |
| 5,303,839 | 4/1994 | Blumenschein | 220/355 |
| 5,377,861 | 1/1995 | Landis | 206/508 X |
| 5,437,386 | 8/1995 | Von Holdt | 220/355 |
| 5,494,186 | 2/1996 | Marsh | 220/324 X |

FOREIGN PATENT DOCUMENTS

| | | |
|---|---|---|
| 860123 | 1/1971 | Canada . |
| 873160 | 6/1971 | Canada . |
| 877118 | 8/1971 | Canada . |
| 892980 | 2/1972 | Canada . |
| 918088 | 1/1973 | Canada . |
| 1176604 | 10/1984 | Canada . |
| 1243283 | 10/1988 | Canada . |
| 1275972 | 11/1990 | Canada . |
| 1308045 | 9/1992 | Canada . |

OTHER PUBLICATIONS

Techstar Plastics Inc., Brochure.

Scepter Reusable Containers, Brochure.

*Primary Examiner*—Allan N. Shoap

*Assistant Examiner*—Robin A. Hylton

*Attorney, Agent, or Firm*—Woodard, Emhardt, Naughton Moriarty & McNett

[57] ABSTRACT

A lid has a manually operable latching arrangement which prevents inadvertent disengagement of the lid from a container body even during severe service conditions. Latching is effected by a captive plate on the lid, the plate carrying a latching strap and a blocking member. In the latching position, the blocking member engages under a lip or flange at the upper edge of the container body, and the plate is retained in the latching position by engagement of the latching strap with an abutment in the lid.

16 Claims, 3 Drawing Sheets

CONTAINER WITH LATCHING LID

BACKGROUND OF THE INVENTION a) Field of the Invention

This invention relates to a new or improved container and latching lid for a container, and to the combination of such lid with a container.

b) Description of the Prior Art

Containers with latching lids are required in many applications. Where such containers are subjected to rough handling in service, it is desirable to provide a latching arrangement which is both robust and unlikely to disengage inadvertently even during violent impacts, and yet can readily be disengaged manually when it is desired to open the container.

SUMMARY OF THE INVENTION

The present invention provides a lid for attachment to a container body that has a base and an upstanding peripheral wall having an upper edge with an outwardly projecting flange; and said lid having an outline similar to that of the container body and comprising a top wall and a depending peripheral skirt that is sized to enclose the top marginal area of the peripheral wall when said lid is positioned on the container body; said lid including latching means for securing it to the container body to prevent inadvertent separation of the lid therefrom, said latching means comprising: a captive plate movably attached to said skirt, said plate carrying a detent member and being movable from a latching position to a release position, said detent means in said latching position being engageable with an abutment surface in said lid to retain said captive plate in the latching position thereof wherein it lies against said skirt; a blocking element carried on said lid and movable, when the lid is positioned on the container, between a blocking position wherein it engages the container and prevents separation of the lid therefrom, and a withdrawn position, said detent member being resiliently displaceable manually out of engagement with said abutment surface to enable movement of said captive plate to the release position thereof to permit separation of said lid from the container body when said blocking element has been moved to its withdrawn position.

The present invention also provides a container comprising: a body having a base and an upstanding peripheral wall that has an upper edge; and a lid having an outline similar to that of said body and comprising a top wall and a depending peripheral skirt that is sized to enclose the top marginal area of said peripheral wall when said lid is positioned on said body; said container including latching means for securing said lid to said body to prevent inadvertent separation of the lid therefrom, said latching means comprising: a captive plate movably attached to said skirt, said plate carrying a detent member and being movable from a latching position to a release position; said detent member in said latching position being engageable with an abutment surface in said lid to retain said captive plate in the latching position thereof wherein it lies against said skirt; a blocking element carried on said lid and movable, when the lid is positioned on the container, between a blocking position wherein it engages the container and prevents separation of the lid therefrom, and a withdrawn position; said detent member being resiliently displaceable manually out of engagement with said abutment surface to enable movement of said captive plate to the release position thereof to permit separation of said lid from said container body when said blocking element has been moved to its withdrawn position.

Preferably the blocking member is mounted on the captive plate to be movable therewith between its blocking and withdrawn positions as the detent member moves between the latching and release positions respectively.

The container and lid may be fabricated in any suitable material, various plastics material such as polyethylene being particularly suitable. The top surface of the lid is preferably recessed to define around the periphery thereof an inverted channel that is of a width to snugly receive the top part of the marginal edge of the peripheral wall of the container. Preferably the container is tapered towards its lower end so that the base of one container will fit within the peripheral channel of the lid of another container and thus provide secure stacking characteristics.

The container lid is preferably rectangular having latching means on two opposite sides, the captive plate being of elongate rectangular form and received in a recessed area of the lid skirt. Conveniently the captive plate is pivoted along the lower edge of the skirt and is of elongate form carrying two or more detent members and two or more blocking elements. The detent member is preferably in the form of a strap that is moulded integrally with the captive plate and defines thereon a shoulder which in the latching position cooperates with an abutment surface formed in the edge of a hole in the lid. The strap has a ramp surface which resiliently deflects the strap as the latter is moved towards the latching position so that when the latching position is reached the resilience of the strap moves the shoulder into overlapping form locking relationship with the abutment surface. The strap may also include wedge surfaces which engage the opposite side of the hole in the lid when in the latching position and prevent disengagement of the shoulder from the abutment as a result of flexure or displacement of the latching plate. In the latching position the latching strap is received in a recess in the top side of the lid and is accessible for manual manipulation to disengage the shoulder from the abutment and move the captive plate to the unlatched position, the blocking member being withdrawn during this movement.

The novel lid arrangement is readily adaptable for use with existing rimmed containers and provides a secure attachment thereto. The captive latching plate is preferably so mounted that in the release position it is still retained with the detent members aligned with the abutment means so that they can be readily re-engaged simply by a relatively small pivotal movement of the captive plate. In the unlatched position, the latching elements preferably form supports providing a means to facilitate stacking of a plurality of such lids for storage or shipping.

It will be understood that additional security in the lid attachment may be provided by applying tie straps around the container and over the captive plates to positively prevent movement of the latter. The captive plate may be mounted for movement otherwise than by the pivotal connection as described herein. For example the captive plate may be designed to slide in a linear manner to move the latching member between the engaged and the release positions.

BRIEF DESCRIPTION OF THE DRAWINGS

The invention will further be described, by way of example only, with reference to the accompanying drawings wherein.

DESCRIPTION OF THE PREFERRED EMBODIMENT

Figure 1:
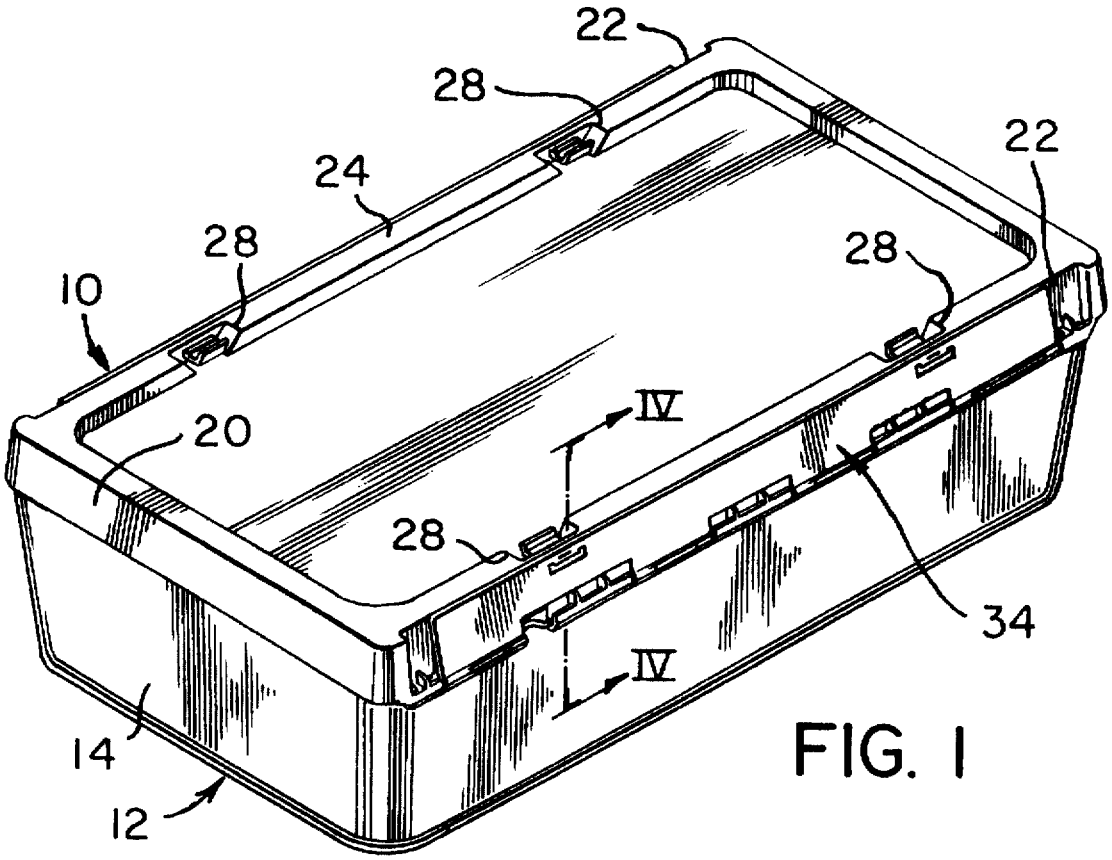
FIG. 1 is a perspective view of a container with lid, the lid being shown latched to the top of the container.
Figure 2:
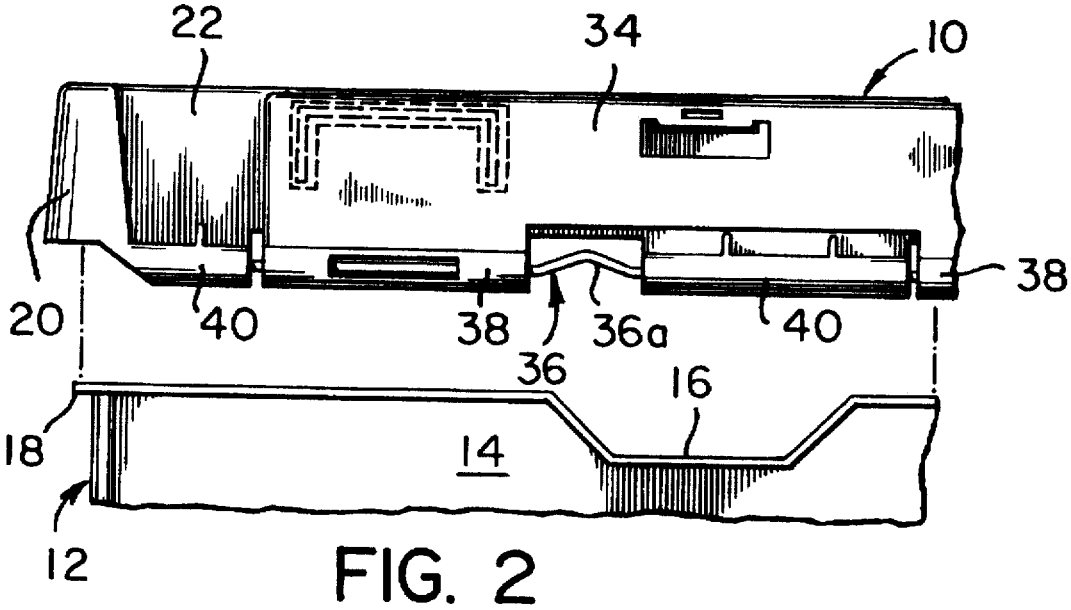
FIG. 2 is a fragmentary exploded elevation view of adjoining portions of the lid and container.
Figure 3:
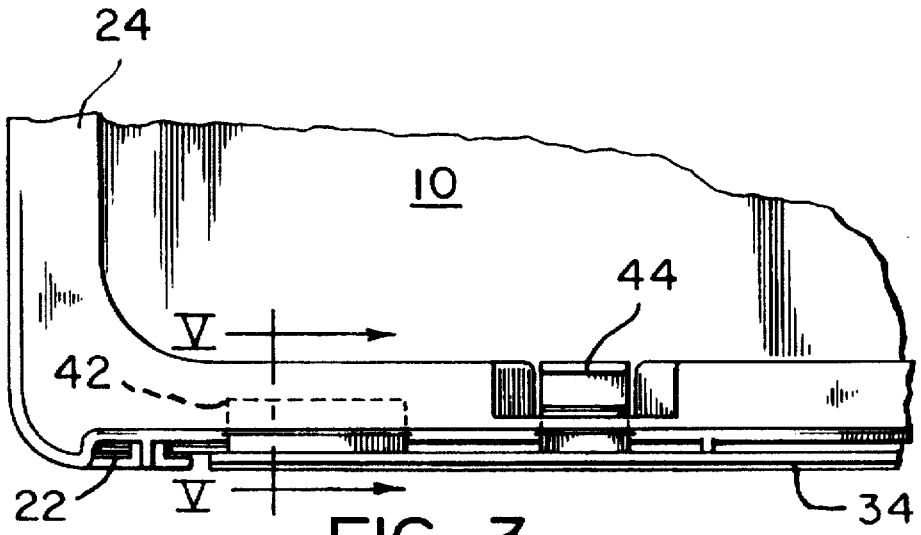
FIG. 3 is a plan view of a portion of the lid.

As shown in FIG. 1, a rectangular lid 10 fits on and cooperates with a rectangular container body 12. The body has a peripheral wall 14 and tapers somewhat towards its lower end as is evident in FIG. 1, the peripheral wall being of uniform height except for four notches 16 (one is shown in FIG. 2) regularly arranged at spaced positions in the longer sides. At the upper end of the wall 14 there is a outwardly projecting flange or lip 18.

Figure 5:
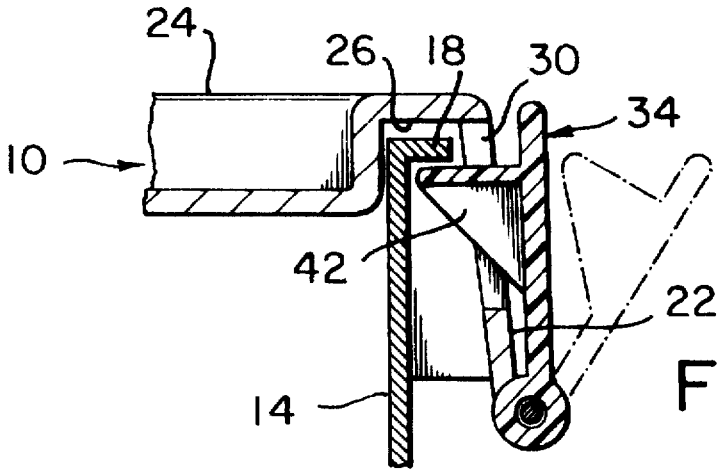
FIG. 5 is a fragmentary sectional view taken on the line V—V in FIG. 3.
Figure 6:
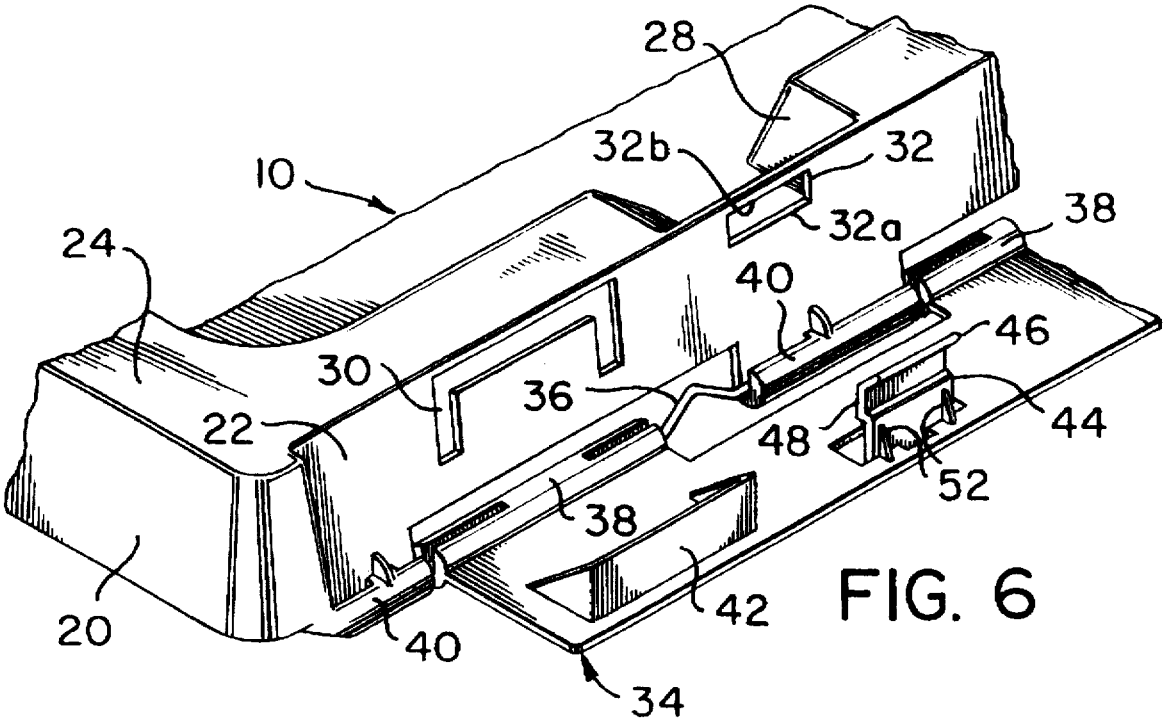
FIG. 6 is a fragmentary perspective view of a portion of the lid.

The lid 10 is surrounded on all four sides by a depending outwardly flared peripheral skirt 20, this skirt having in each of its longer sides an elongate recessed area 22 extending throughout substantially the entire length of that side. The central area of the top of the lid is recessed to form a peripheral ridge 24. The lid 10 is of thin-walled construction so that the underside of the lid defines a downwardly open channel 26 of inverted U-shape profile as seen in FIG. 5. This channel is interrupted at four locations as seen in FIG. 1 to define recesses 28 which are bounded on their outboard sides by the wall of the skirt 20, as best seen in FIG. 6, there being a rectangular aperture 32 in this part of the skirt wall. Adjacent aperture 32 is a second aperture 30, the latter being of inverted U-shaped outline, and both apertures being positioned within the recessed area 22.

As best seen in FIG. 6, a captive plate 34 of elongate rectangular form is pivotally attached along the lower edge of the recessed area 22 of the skirt by means of a steel wire 36 (The position of the parts shown in FIG. 6 is for clarity of illustration only, and in service the plate 34 does not diverge from the skirt recess 22 by such a large angle). The wire 36 acts as a hinge pin and passes through spaced aligned bosses 38 in the plate 34 and bosses 40 at the lower edge of the skirt 20. The captive plate 34 is fabricated as a moulding in a suitable plastic material so that although stiff, it has an inherent degree of resilience. Integrally formed with the plate is a U-shaped blocking element 42 and a projecting detent strap 44, these being in register with the apertures 30 and 32 respectively.

Figure 4A:
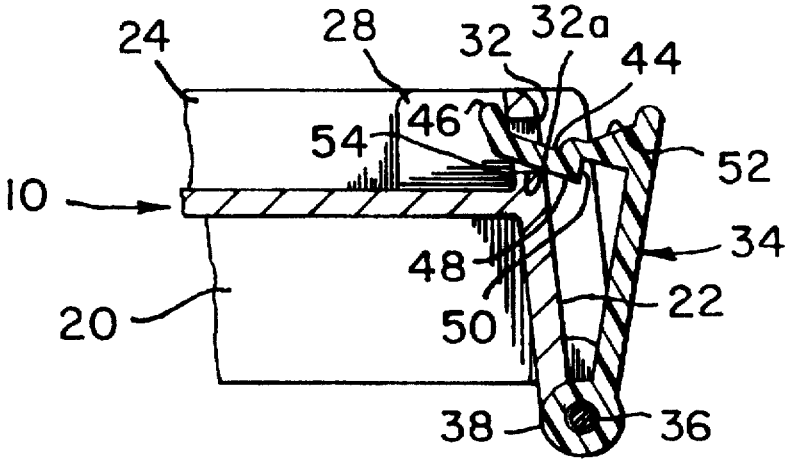
FIG. 4A is an enlarged sectional view taken on the line IV—IV in FIG. 1.
Figure 4B:
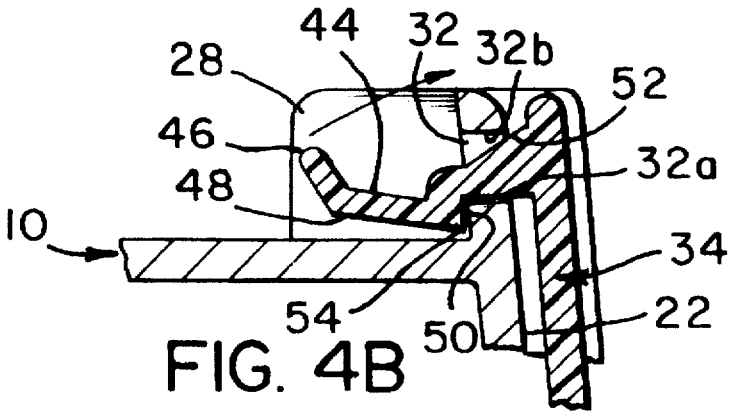
FIG. 4B is an enlarged detail of FIG. 4A showing with the parts in a different position.

The structure of the detent strap 44 is most clearly seen in FIGS. 4A, 4B and 6. The strap projects substantially normal to the plate 34 and has an upwardly angled nose 46, a generally straight intermediate ramp part 48 which terminates in a recessed shoulder 50, and a root portion 52 adjoining the plate 34 and of wedge-shaped profile, increasing in thickness towards the plate 34. From the foregoing it will be understood that when the plate 34 is in the opened unlatched condition as shown in FIG. 4A, the lid can be placed on top of the container body 12 and removed therefrom without hinderance. However, when the lid is placed on top of the body 14 and the plates 34 are swung into the latching position as shown in FIG. 1, then the lid is securely latched to the body. The upwardly angled nose 46 of the detent strap 44 provides an ergonomic grip that is readily manipulated by the user to release the lid.

While for ease of illustration FIG. 6 shows the captive plate 34 extending at an angle of more than 90° to the lid skirt 20, in reality the plate 34 is controlled for movement through a relatively small angular range between the positions shown in FIGS. 4A and 4B. In the release position shown in FIG. 4A the plate 34 is limited from further movement by engagement of the nose part 46 of the detent strap 44 with the upper edge of the aperture 32. From this position the latching means can easily and rapidly be re-engaged simply by pressing the upper part of the plate 34 towards the inverted channel 26.

In the release position of the plate 34 the detent straps 44 provide support means whereby two or more such lids can be stacked, the bosses 38 at the lower edges of the skirt 20 of an upper lid resting on the detent straps 44 of a lower container.

With reference to FIG. 4A, as the latching plate is swung towards the latching condition, the nose 46 of the strap 44 will pass into the recess 28, moving freely until the ramp part 48 of the strap engages the lower side **32*a* of the hole. Continued swinging of the plate 34 towards the latched condition causes the strap 44 to be resiliently flexed upwardly to allow the shoulder 50 to pass through the opening 32, and once this occurs the strap 44 is resiliently restored to its normal position whereupon the shoulder 50 is located behind the abutment surface 54 (which is adjacent the lower edge 32*a*** of the opening) this latching position being shown in FIG. 4B.

It will be noted that in the latching position the wedge shaped root 52 (which as shown in FIG. 6 may comprise two spaced ramps) sits in close proximity to the upper edge **32*b* of the opening 32 so that the strap 44 is securely retained in the latching position with the plate 34 fully received within the recessed portion 22 of the skirt. In the latching condition as shown in FIG. 5 the blocking elements 42 extend through their respective openings 30 in the skirt and engage under the flange 18 at the top end of the container wall 14**, and thus form a secure attachment between the lid and the container.

Although FIG. 5 for ease of illustration shows substantial clearance between the flange 18 and the surrounding parts of the lid and latching structure, in fact the tolerances of the parts can be tightly controlled to keep such clearance to a minimum and to thus enhance the tightness and security of the connection.

The nature of the lid connection is such that it will not readily be accidentally broken even in severe service conditions. Deflection of the lid will not detach it since the upper part of the wall 14 will follow any such lid deflections because of the positioning of the flange 18 within the channel 26 in the lid. Similarly deflections of the wall 14 will not detach the connection. Any normal deflections of the skirt 20 of the lid or of the plates 34 will not cause disengagement. In this connection it should be remarked that although flexure or minor displacement of the plate 34 during movement towards the latching position can assist the detent strap 44 in passing into the opening 30, once the latching position has been established, it is not likely to be weakened by such displacement or flexure. A consideration of FIG. 4B will suggest that to disengage the shoulder 50 from the abutment 54, a sufficient degree of flexure must take place in the length of the strap between where it contacts the edge **32*b* and its free end 46**. Thus effectively, the stiffness of the connection against releasing forces is higher than against engagement forces.

It will be noticed that in the latched position the straps 44 are shielded within the recesses 28 in the lid, and are therefore unlikely to be moved accidentally, while nonetheless being readily accessible for manual manipulation towards the unlatching position.

As a security measure to prevent unauthorized access to the container by removing the lid after withdrawal of the steal hinge wire 36, the latter is configured as shown in FIG. 2 to have a bent region 36*a* formed in it after it has been inserted. This bent region 36*a* of course will not pass through the holes in the boxes 38 and 40, so that the wire 36 cannot be removed without leaving evidence that the lid has been tampered with. This feature therefore adds to the security of the latched container in security sensitive applications. Security seals can also be attached to the closed container.

It will further be evident that a container closed with a latching lid as described above is effectively sealed against the elements since there are no holes in either the lid or the body of the container that would expose the contents of the container to rain or the like.

What we claim as our invention is:

1. A container assembly comprising:

a body having a base and an upstanding peripheral wall that has a top marginal area extending along an upper edge thereof; and a lid having an outline similar to that of said body and comprising a top wall and a depending peripheral skirt that is sized to enclose the top marginal area of said upstanding peripheral wall when said lid is positioned on said body;

said assembly including latching means for securing said lid to said body to prevent inadvertent separation of the lid therefrom, said latching means comprising:

a captive plate movably attached to said depending peripheral skirt, said captive plate carrying a detent member and being movable from a latching position to a release position;

said detent member in said latching position being engageable with an abutment surface in said lid to retain said captive plate in the latching position thereof wherein said captive plate lies against said depending peripheral skirt;

a blocking element carried on said captive plate and movable therewith, when the lid is positioned on the body, between a blocking position wherein said blocking element engages the body and prevents separation of the lid therefrom, and a withdrawn position;

said detent member being resiliently displaceable manually out of engagement with said abutment surface to enable movement of said captive plate to the release position thereof and simultaneous movement of said blocking element to said withdrawn position to permit separation of said lid from said body.

2. A container assembly as claimed in claim 1 wherein said top surface of the lid is recessed to provide around the periphery thereof an inverted channel that is of a width to snugly receive the top marginal edge area of said upstanding peripheral wall.

3. A container assembly as claimed in claim 1 wherein said upstanding peripheral wall of the body has at its upper end an outwardly projecting flange beneath which said blocking element engages.

4. A container assembly as claimed in claim 3 which is of generally rectangular outline and includes latching means on two opposed sides thereof, each latching means comprising a captive plate as aforesaid that in the latching position is received in a respective recessed area of said depending peripheral skirt.

5. A container assembly as claimed in claim 1 wherein said captive plate is pivotally attached to said depending peripheral skirt.

6. A container assembly as claimed in claim 5 wherein said captive plate is of elongate form and is pivotally attached along the lower end of said depending peripheral skirt.

7. A container assembly as claimed in claim 6 wherein said depending peripheral skirt includes an aperture which registers with said blocking element and through which said blocking element passes when said captive plate is moved to the latching position.

8. A container assembly as claimed in claim 5 wherein said detent member cooperates with a hole in a top part of said depending peripheral skirt, said abutment surface adjoining said hole.

9. A container assembly as claimed in claim 8 wherein adjacent said hole there is a recess defined in the top of said lid, said detent member being received in said recess and being accessible for manual manipulation when said captive plate is in the latching position.

10. A container assembly as claimed in claim 9 wherein said detent member is a strap of resilient material that is fixed with respect to said captive plate and which has a ramp surface extending from the free end thereof and terminating at a shoulder that is spaced from and oriented towards said captive plate, said strap being located such that as the captive plate moved to the latching position the ramp surface cooperates with an edge of said hole to resiliently deflect the strap such that when said shoulder passes beyond said abutment surface, the strap is resiliently restored towards a position wherein said shoulder is in register to engage with said abutment surface.

11. A lid for attachment to a container body that has a base and an upstanding peripheral wall having an upper edge with an outwardly projecting flange; and said lid having an outline similar to that of the container body and comprising a top wall and a depending peripheral skirt that is sized to enclose a top marginal area of the peripheral wall when said lid is positioned on the container body;

said lid including latching means for securing said lid to the container body to prevent inadvertent separation of the lid therefrom, said latching means comprising:

a captive plate movably attached to said depending peripheral skirt, said captive plate carrying a detent member and being movable from a latching position to a release position, said detent member in said latching position being engageable with an abutment surface in said lid to retain said captive plate in the latching position thereof wherein said captive plate lies against said depending peripheral skirt;

a blocking element carried on said lid and movable, when the lid is positioned on the container, between a blocking position wherein said blocking element engages the container body and prevents separation of the lid therefrom, and a withdrawn position, said blocking element being mounted on said captive plate to be movable therewith between said blocking and withdrawn positions as the detent member moves between said latching and release positions, respectively;

said detent member being resiliently displaceable manually out of engagement with said abutment surface to enable movement of said captive plate to the release position thereof to permit separation of said lid from the container body when said blocking element has been moved to said withdrawn position.

12. A lid as claimed in claim 11 having a top surface that is recessed to define around the periphery thereof an inverted channel which is of a width to snugly receive the top marginal area of the peripheral wall of a container.

13. A lid as claimed in claim 12 wherein said detent member cooperates with a hole through said inverted channel and in the latching position is accessible for manual manipulation at the periphery of the recessed top surface of the lid.

14. A lid as claimed in claim 13 wherein said detent member is a strap of resilient plastic material that is fixed with respect to said captive plate and which has a ramp surface extending from the free end thereof and terminating at a shoulder that is spaced from and oriented towards said captive plate, said strap being located such that as the captive plate is moved towards the latching position the ramp surface cooperates with an edge of said hole in the inverted channel to resiliently deflect the strap such that when said shoulder passes beyond said abutment surface the strap is resiliently restored towards a position wherein said shoulder is in register to engage with said abutment surface.

15. A lid as claimed in claim 11 which is of generally rectangular outline and which includes on each of two opposed sides thereof a recess area that is sized to receive a captive plate as aforesaid when the latter is in the latching position.

16. A lid as claimed in claim 15 wherein each said captive plate is of elongate generally rectangular form and is pivotally attached along the lower end of said depending peripheral skirt.

* * * * *